US006315662B1

(12) United States Patent
Jorasch et al.

(10) Patent No.: US 6,315,662 B1
(45) Date of Patent: Nov. 13, 2001

(54) SYSTEM AND METHOD FOR AUTOMATICALLY INITIATING GAME PLAY ON AN ELECTRONIC GAMING DEVICE

(75) Inventors: James A. Jorasch, Stamford; Jay S. Walker, Ridgefield; Magdalena Mik, Greenwich, all of CT (US); Jason C. Krantz, New York, NY (US)

(73) Assignee: Walker Digital, LLC, Stamford, CT (US)

( * ) Notice: Subject to any disclaimer, the term of this patent is extended or adjusted under 35 U.S.C. 154(b) by 0 days.

(21) Appl. No.: 09/218,258

(22) Filed: Dec. 22, 1998

(51) Int. Cl.[7] ..... A63F 9/24
(52) U.S. Cl. ..... 463/20; 463/16; 463/25
(58) Field of Search ..... 463/20, 16–19, 463/12, 13; 273/138.1, 138.2, 139, 143 R, 138 A

(56) References Cited

U.S. PATENT DOCUMENTS

| | | | | |
|---|---|---|---|---|
| 3,819,186 | | 6/1974 | Hinterstocker . | |
| 4,099,722 | | 7/1978 | Rodesch et al. . | |
| 4,321,673 | | 3/1982 | Hawwass et al. . | |
| 4,373,727 | | 2/1983 | Hooker et al. . | |
| 4,508,345 | | 4/1985 | Okada . | |
| 4,524,636 | | 6/1985 | Nishikawa . | |
| 4,998,199 | | 3/1991 | Tashiro et al. . | |
| 5,127,651 | | 7/1992 | Okada . | |
| 5,152,529 | * | 10/1992 | Okada | 463/20 |
| 5,188,363 | | 2/1993 | Marnell et al. . | |
| 5,393,061 | * | 2/1995 | Manship et al. | 63/20 |
| 5,704,835 | | 1/1998 | Dietz . | |
| 5,848,932 | * | 12/1998 | Adams | 463/20 |
| 6,007,066 | * | 12/1999 | Moody | 463/13 |

OTHER PUBLICATIONS

"Innovative Gaming Announces Nevada Approval of IGT Joint Venture Game—Bonus Streak", PR Newswire, May 14, 1997, Financial News Section.

Scott Shackelton, "Colorado To Allow Electronic Roulette Games In Casinos", Innovative Gaming Corporation of America, Aug. 19, 1997.

"Innovative Gaming Corporation of America Submits Bonus Streak (TM) In Mississippi for Approval", PR Newswire, May 6, 1998,Financial News Section.

Rose De Wolf, "New Slot Machine Has A Rock 'N Roll", The Houston Chronicle, Jul. 12, 1998 Sunday 2 Star Edition, Travel Section at p. 4.

Rose De Wolf, "Singing Elvis to Lure Vegas Gamblers: Images, Music on Slot Machine", The Florida Times–Union (Jacksonville, FL), Aug. 2, 1998 Sunday City Edition, Travel Section at p. E–2.

"BJ Blitz", Innovative Gaming Corporation of America, Brochure.

"Hot Shot", Innovative Gaming Corporation of America, Brochure.

"Bonus Streak", Innovative Gaming Corporation of America, Brochure.

"Lightning Strike", Innovative Gaming Corporation of America, Brochure.

* cited by examiner

*Primary Examiner*—Michael O'Neill
(74) *Attorney, Agent, or Firm*—Dean P. Alderucci

(57) ABSTRACT

An electronic gaming device, such as a slot machine, is provided which initiates a game without input from a player. After initiating the game, the device may present one or more active game elements, such as rotating slot reels, to the player. The device determines an outcome of the game corresponding to a final position of the active game elements. The device further provides an interval to the player to make payment before the final outcome of the game is displayed. Payouts to the player are based on the final outcome and whether the player has made payment. Payouts may be increased based on a measurement of the player's participation rate in a series of games and the frequency of the games played, as measured by the device.

20 Claims, 6 Drawing Sheets

119

| PARTICIPATION RATE (NUMBER OF ACTUAL GAMES PER NUMBER OF POSSIBLE GAMES) 302 | FREQUENCY OF OUTCOMES ADJUSTMENT 304 |
|---|---|
| 95% OR GREATER | INCREASE BY 10% |
| 85%-95% | NO ADJUSTMENT |
| LESS THAN 85% | DECREASE BY 10% |

118

| FREQUENCY OF OUTCOMES (GAMES / HR.) 402 | PAYOUT MULTIPLIER 404 |
|---|---|
| < 700 | 1 |
| 7001 - 800 | 1.02 |
| > 800 | 1.03 |

116

| OUTCOME 202 | DEFAULT PAYOUT 204 |
|---|---|
| NONWINNING COMBINATION | 0 |
| CHERRY / ANY / ANY | 2 |
| ANY / ANY / CHERRY | 2 |
| CHERRY / CHERRY / ANY | 5 |
| ANY / CHERRY / CHERRY | 5 |
| CHERRY / ANY / CHERRY | 5 |
| CHERRY / CHERRY / CHERRY | 20 |
| BAR / ORANGE / ORANGE | 10 |
| ORANGE / ORANGE / BAR | 10 |
| ORANGE / ORANGE / ORANGE | 20 |
| BAR / PLUM / PLUM | 14 |
| PLUM / PLUM / BAR | 14 |
| PLUM / PLUM / PLUM | 20 |
| BAR / BELL / BELL | 18 |
| BELL / BELL / BAR | 18 |
| BELL / BELL / BELL | 20 |
| BAR / BAR / BAR | 50 |
| 7 / 7 / 7 | 100 |

FIG. 2A

114

| OUTCOME 206 | DEFAULT | | BONUS | |
|---|---|---|---|---|
| | RANDOM NUMBER 208 | EXPECTED HITS PER CYCLE 210 | RANDOM NUMBER 212 | EXPECTED HITS PER CYCLE 214 |
| NONWINNING COMBINATION | 1-8570 | 8570 | 1-8604 | 8604 |
| CHERRY / ANY / ANY | 8571-9250 | 680 | 8605-9284 | 680 |
| ANY / ANY / CHERRY | 9251-9930 | 680 | 9285-9964 | 680 |
| CHERRY / CHERRY / ANY | 9931-10130 | 200 | 9965-10164 | 200 |
| ANY / CHERRY / CHERRY | 10131-10330 | 200 | 10165-10364 | 200 |
| CHERRY / ANY / CHERRY | 10331-10398 | 68 | 10365-10432 | 68 |
| CHERRY / CHERRY / CHERRY | 10399-10418 | 20 | 10433-10452 | 20 |
| BAR / ORANGE / ORANGE | 10419-10460 | 42 | 10453-10494 | 42 |
| ORANGE / ORANGE / BAR | 10461-10466 | 6 | 10495-10500 | 6 |
| ORANGE / ORANGE / ORANGE | 10467-10508 | 42 | 10501-10542 | 42 |
| BAR / PLUM / PLUM | 10509-10528 | 20 | 10543-10562 | 20 |
| PLUM / PLUM / BAR | 10529-10533 | 5 | 10563-10567 | 5 |
| PLUM / PLUM / PLUM | 10534-10583 | 50 | 10568-10592 | 25 |
| BAR / BELL / BELL | 10584-10587 | 4 | 10593-10596 | 4 |
| BELL / BELL / BAR | 10588-10607 | 20 | 10597-10616 | 20 |
| BELL / BELL / BELL | 10608-10627 | 20 | 10617-10636 | 20 |
| BAR / BAR / BAR | 10628-10647 | 20 | 10637-10646 | 10 |
| 7 / 7 / 7 | 10648 | 1 | 10647-10648 | 2 |

FIG. 2B

119

| PARTICIPATION RATE (NUMBER OF ACTUAL GAMES PER NUMBER OF POSSIBLE GAMES) 302 | FREQUENCY OF OUTCOMES ADJUSTMENT 304 |
|---|---|
| 95% OR GREATER | INCREASE BY 10% |
| 85%-95% | NO ADJUSTMENT |
| LESS THAN 85% | DECREASE BY 10% |

FIG. 3

118

| FREQUENCY OF OUTCOMES (GAMES / HR.) 402 | PAYOUT MULTIPLIER 404 |
|---|---|
| < 700 | 1 |
| 7001 - 800 | 1.02 |
| > 800 | 1.03 |

FIG. 4

SYSTEM AND METHOD FOR AUTOMATICALLY INITIATING GAME PLAY ON AN ELECTRONIC GAMING DEVICE

FIELD OF THE INVENTION

This invention relates to an electronic gaming device, and relates more particularly to an electronic gaming device, such as a mechanical slot machine, which initiates game play automatically rather than at the request of a player.

BACKGROUND OF THE INVENTION

Electronic gaming devices, such as slot machines and video poker machines, generate the bulk of profits at most casinos. It is estimated that electronic gaming devices account for over $15 billion in revenue each year in the United States. Electronic gaming devices remain an attractive source of revenue because their low operating cost results in margins significantly higher than table games such as blackjack and craps.

Gaming machine profitability is directly related to such factors as the statistical house advantage offered by the machine, the amount of money wagered by players, and the rate at which the machine is played. In order to increase the profitability of these machines, many attempts have been made to augment one or more of these factors.

With regard to augmenting the house advantage, many gaming machines have been developed with higher-than-average house advantages. However, there are several drawbacks to this approach. First, many jurisdictions legislate minimum payback levels which, in turn, limit the amount by which the house advantage may be increased. Also, players tend to avoid machines that have a large house advantage, and will further avoid casinos which have an abundance of these machines. This is particularly true in those jurisdictions which require casinos to publish the house advantage tendered by their machines.

With regard to augmenting the amount of money wagered by players, gaming machines have been developed which require more money to be deposited in order to play them. Such "high stakes" slot machines require the deposit of $5.00 to $500.00 for each play. However, as the amount required to be wagered increases, fewer players are willing or able to play. This is because few players have sufficient finds to play "high stakes" machines. Thus, a casino can not increase the amount required to be wagered on a majority of its machines without negatively impacting the number of players willing to play at those machines.

In an attempt to augment the rate at which a machine is played by a player, some gaming machines have been developed which allow a player to operate the machine at faster rates of play. For example, in some slot machines, reel mechanisms have been designed to rotate quickly and stop within a few seconds, making them faster than prior slot machines. Such machines, however, operate faster only after a player has made a decision to play the game. They do not encourage a player to make the decision to play any faster. For instance, a player may wait for an interval after completion of a first game before initiating a second game. Thus, although the machine may complete a game in a shorter period of time, they do not necessarily increase profitability of the machine since players may delay their decision to play or to continue to play the machine.

Thus, a need exists for a system and method that encourages players to participate in a greater proportion of games to effectuate a faster rate of play.

SUMMARY OF THE INVENTION

Generally, according to the instant invention, systems and methods are disclosed for directing the operation of an electronic gaming device. Such systems and methods are advantageous in that they encourage greater participation rates and greater frequencies of outcomes of electronic gaming devices, thereby increasing profitability without altering the house advantage or the minimum amount required to be wagered.

According to a first aspect of the invention, a system and method for directing the operation of an electronic gaming device includes generating a random number for a game, determining an outcome of the game based on the random number, spinning a slot reel having a position corresponding to the outcome, providing to a player, after the spinning step, an interval to make a payment for the game; and revealing the position to the player after the interval, thereby displaying the outcome of the game.

According to a second aspect of the invention, a system and method for directing the operation of an electronic gaming device includes spinning a slot reel, receiving an input from a player after the spinning step, generating a random number in response to the input, determining an outcome based on the random number with the outcome corresponding to a position of the slot reel, and stopping the slot reel at the position corresponding to the determined outcome after the receiving step.

According to a third aspect of the invention, a system and method for directing the operation of an electronic gaming device includes spinning a plurality of slot reels, generating a random number, determining an outcome based on the random number with the outcome corresponding to a position of one of the plurality of slot reels, stopping the one of the plurality of slot reels at the position corresponding to the determined outcome and providing, to a player, an interval to make a payment.

According to a fourth aspect of the invention, a system and method for directing the operation of an electronic gaming device includes displaying a video representation of a back of a card for a game, generating a random number for the game, determining a value of the card based on the random number, providing, to a player after the determining step, an interval to make a first payment and revealing the value to the player after the interval.

According to a fifth aspect of the invention, a system and method for directing the operation of an electronic gaming device includes initiating a plurality of games, each of the plurality of games having a payout table associated therewith, determining an outcome of each of the plurality of games, measuring at least one of a participation rate and a frequency of outcomes for the plurality of games, and adjusting a game parameter for a subsequent game based on the measuring step.

According to a sixth aspect of the invention, a system and method for directing the operation of an electronic gaming device includes providing, to a player, an interval to make a payment for a game, generating a signal after a first predetermined time, spinning a slot reel after a second predetermined time, generating a random number in response to the signal, the random number corresponding to a position of the slot reel, and stopping the slot reel at the position.

The embodiments of the instant invention provide several significant advantages over the prior art. Since games may be automatically commenced by the electronic gaming device, a player is encouraged to participate in these games at a pace set by the operator of the electronic gaming device. As the player maintains or increases his participation rate at a predetermined level, the machine may increase the frequency of outcomes, thus inducing the player to play more frequently. Additionally, a player who feels that he or she is experiencing a losing streak may wait for a series of automatically initiated games to pass without participating. The player may observe the outcomes of these games and continue play when she feels that the machine is due to provide more favorable outcomes. Thus, although a player may refrain from participating in games at times, he or she is encouraged to stay at the machine and rejoin play when he or she is comfortable with the machine's performance.

A more complete understanding of the present invention, as well as further features and advantages of the present invention, will be obtained by reference to the following detailed descriptions and drawings.

BRIEF DESCRIPTION OF THE DRAWINGS

FIG. 2A depicts a payout table stored in the memory of the electronic gaming device of FIG. 1;

FIG. 2B depicts a probability table stored in the memory of the electronic gaming device of FIG. 1;

FIG. 3 depicts a frequency of outcomes table stored in the memory of the electronic gaming device of FIG. 1;

FIG. 4 depicts a bonus table stored in the memory of the electronic gaming device of FIG. 1;

DETAILED DESCRIPTION OF THE PREFERRED EMBODIMENTS

Electronic gaming device 100 is preferably a standard slot machine modified to run in a default mode and a bonus mode and further modified to automatically commence games, as discussed below. In default mode, the machine operates at, for example, an average rate of six hundred spins per hour, or one spin every six seconds. The rate at which the machine operates in bonus mode may be inched according to player performance, particularly with respect to a player's participation rate, likewise discussed below. In an alternate embodiment, electronic gaming device 100 may be a video slot machine or a video poker machine. In these embodiments, reel controller 132 and reels 134, 136 and 138 may be replaced by a video display (not shown) which displays to a player an appropriate representation of video slot reels or video poker cards, as is well known in the art.

Figure 1:
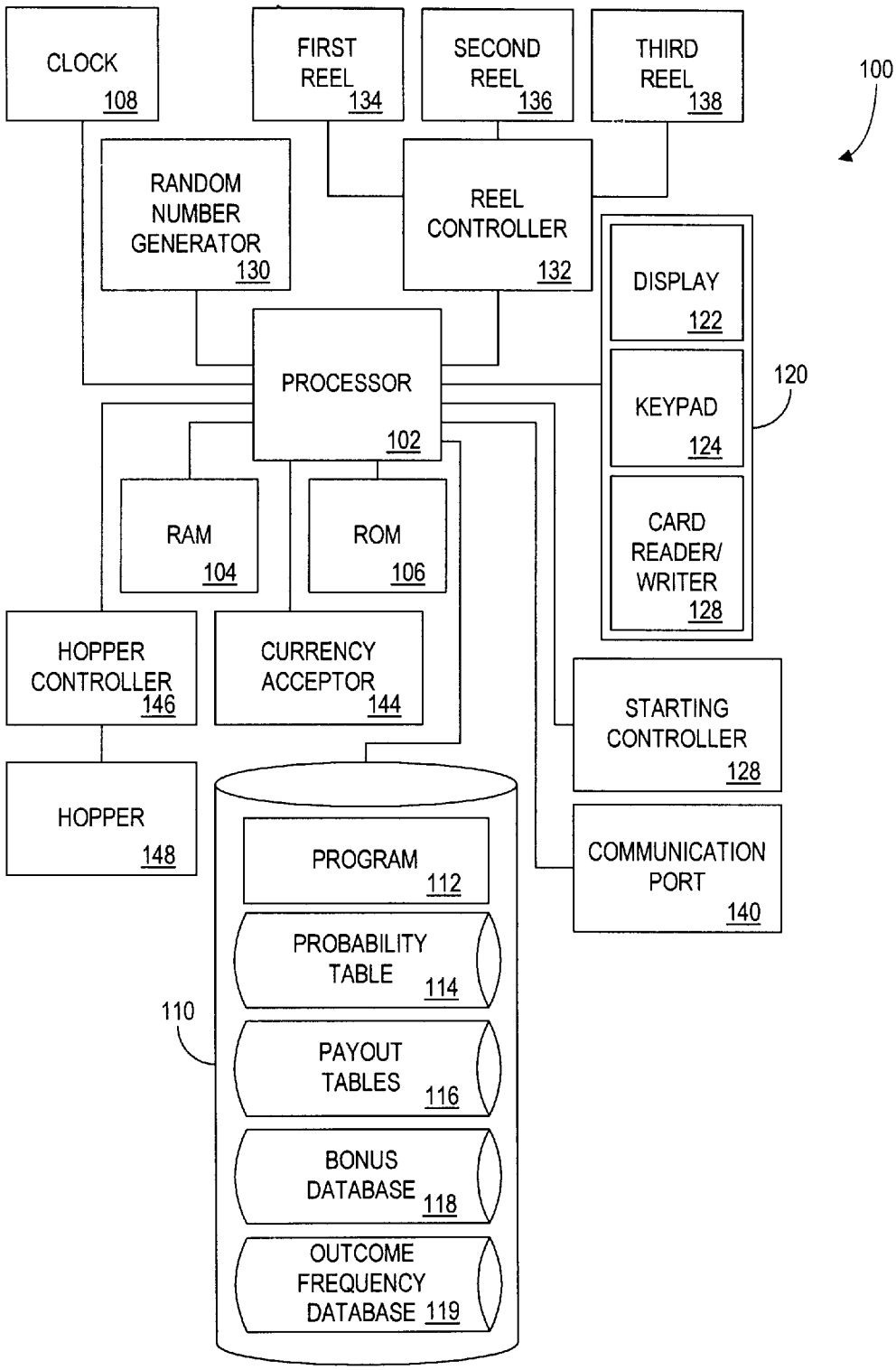
FIG. 1 is a schematic block diagram illustrating the components of an electronic gaming device of the instant invention.

The present invention will now be discussed with reference to the accompanying figures along with the preferred embodiment of a standard mechanical slot machine. FIG. 1 is a block diagram showing the architecture of an electronic gaming device 100. The electronic gaming device 100 includes known hardware components, such as a processor 102, which may be any commonly available microprocessing chip such as the PENTIUM II chip manufactured by INTEL. Processor 102 is shown in communication with each of a data storage device 110, a read only memory (ROM) 106, a random access memory (RAM) 104, a clock 108, and a communications port 140. Processor 102 can be in communication with the data storage device 110, the read only memory (ROM) 106, the random access memory (RAM) 104, the clock 108, and the communications port 140, either by means of a shared data bus, or dedicated connections, as is well-known in the art. Furthermore, processor 102 may be embodied as a single processor, or a number of processors.

Processor 102 runs at a clock speed (typically measured in MHz) determined by clock 108. Clock 108 sends timing signals to processor 102 for controlling the processor speed and for synchronizing data and processing instructions among the components of electronic gaming device 100. Clock 108 may further be used to measure the passage of time.

Random access memory (RAM) 104 may be one or more single inline memory module (SIMM) chips capable of storing a predetermined amount of data (typically measured in megabytes) and used by processor 102 for temporary storage of processing instructions and data during operation of electronic gaming device 100. Read-only memory (ROM) 106 is at least one permanent non-erasable and non-rewritable memory chip that stores initializing instructions to be used by processor 102 during a start-up routine (not shown) performed by electronic gaming device 100. Further functions of random access memory (RAM) 104 and read-only memory (ROM) 106 will be apparent to one of ordinary skill in the art.

Figure 5A:
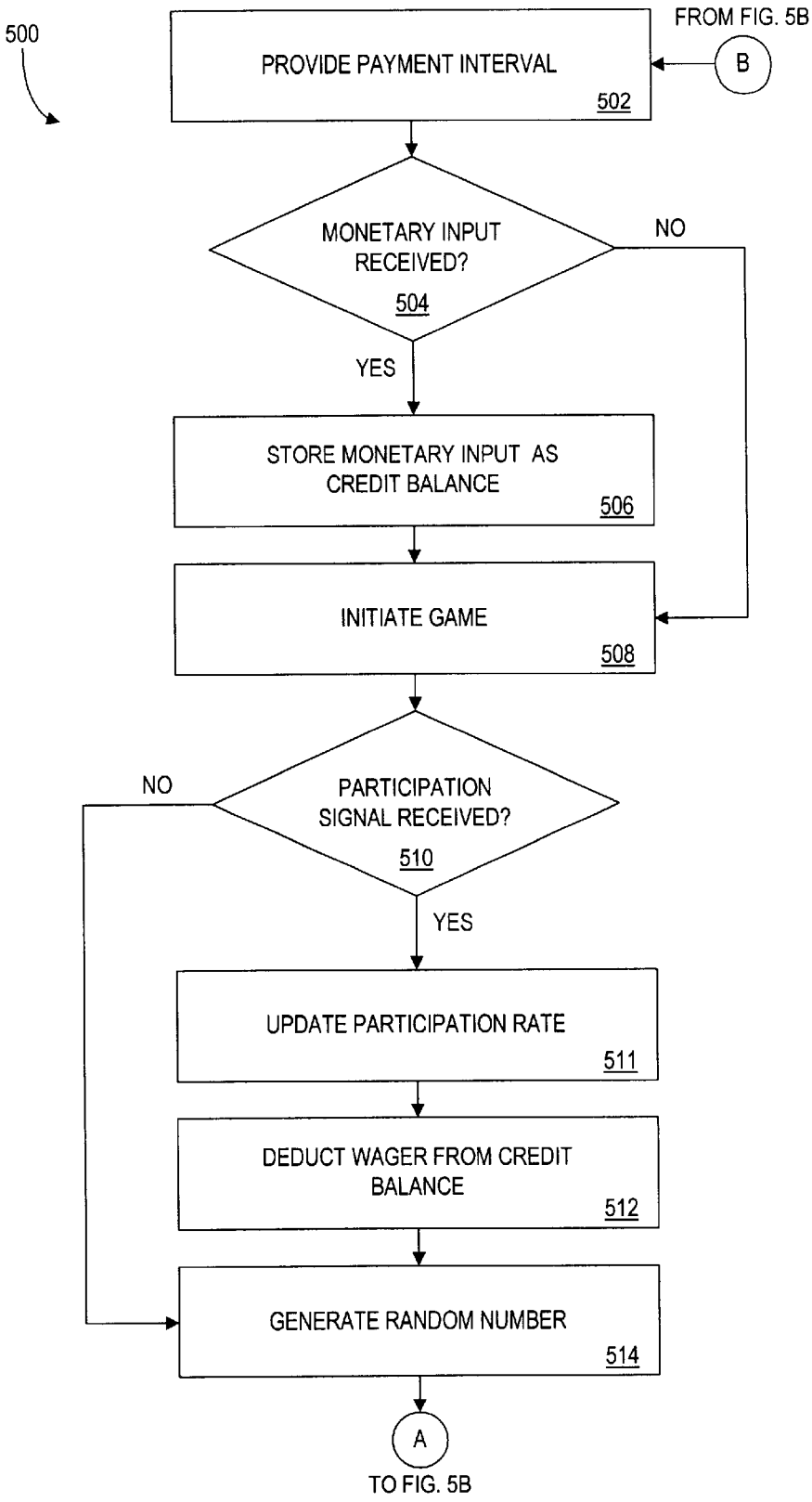
FIGS. 5A and 5B are a flow chart illustrating the process steps by which the electronic gaming device of FIG. 1 initiates and completes a game according to the present invention.
Figure 5B:
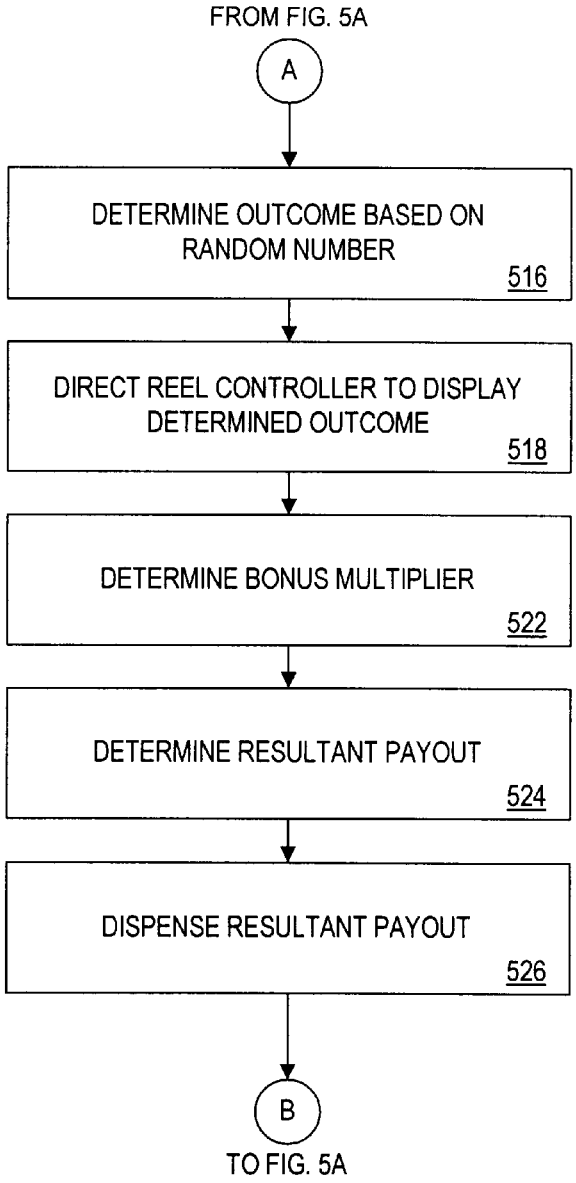

The data storage device 110 and/or ROM 106 are operable to store one or more instructions and data, which the processor 102 is operable to retrieve, interpret and execute. The data storage device 110 may be any one of the following commonly known peripherals used for storing computer instructions and data: a hard drive, a floppy disk drive, a DVD drive of the type manufactured by Philips Electronics, a ZIP drive of the type manufactured by IOMEGA, a tape drive and a Digital Audio Tape drive. Further such devices will be apparent to one of ordinary skill in the art. Data storage device 110 is operative to store a program 112, a probability table 114, a payout table 116, a bonus database 118 and a frequency of outcomes database 119. In accordance with a preferred embodiment of the present invention, the program 112 contains processing instructions for directing processor 102 to retrieve and perform the process steps as shown in FIGS. 5A and 5B, each of which is discussed in detail below. Program 112 is further operative to store an operating system used for operating the processor 102, as will be apparent to one of ordinary skill in the art.

Communications port 140 may be any input/output port commonly used for computer communications, such as a modem or other data transfer device. The communications port 140 connects the electronic gaming device 100 to a network (not shown), thereby permitting the electronic gaming device 100 to communicate with, for example, a central network server (not shown) to transmit data such as player tracking information received through card reader/writer 126, discussed further below. The communication port 140 may include multiple communication channels for simultaneous connections.

Processor 102 is further operatively connected to hopper controller 146. Hopper controller 146 controls the dispensing of money by electronic gaming device 100 to hopper 148. The hopper controller 146 is connected to a hopper 148 for dispensing coins. For example, a player can cash out in a conventional manner by pushing a cash out button (not shown) on electronic gaming device 100. The processor 102 then checks data stored in RAM 104 or data storage device 110 to determine if the player has any available credits and, if so, signals the hopper controller 146 to release an appropriate number of coins into a hopper 148, where it may be collected by a player.

Processor 102 is further operatively connected to currency acceptor 144. A player may deposit currency with electronic gaming device 100 in the form of coinage, bills, or in electronic form (e.g. from a credit card, debit card or smart card). Currency acceptor determines the amount of currency deposited (e.g. the amount of credits in the device), and transmits such information to processor 102 which stores the credit information in an appropriate register (not shown) in RAM 104 and/or data storage device 110.

Processor 102 is preferably connected to starting controller 128. Starting controller 128 is an input device, such as a button, handle, touch-screen or other commonly known input device, and is used by the player to signal his participation in a game offered by electronic gaming device 100. Actuating starting controller 128 may signal that a player who has deposited credits in the device 100 wishes to participate in the next automatically initiated game, as discussed further below in reference to FIGS. 5A and 5B. Alternatively, it may signal that a player wishes a game to commence immediately, thereby starting a game manually rather than waiting for automatic initiation by device 100. Also, a second depression of starting controller may signal that a player wishes the wheels to stop spinning, thereby forcing the device 100 to display an outcome more quickly. Finally, a deposit of coins into currency acceptor 144 may serve to substitute for the actuation of starting controller 128, as may be apparent to one of ordinary skill in the art.

A player tracking device 120 is also in communication with the processor 102. The player tracking device 120 comprises a card reader/writer 126 for reading player identification information stored on a player tracking card (not shown), which is preferably encoded with information to identify the player, in a known manner. The player tracking device 120 also preferably includes a display 122, having an associated player interface, such as a numeric keypad 124 for entry of player information. The player card tracking device may be embodied, for example, as the Mastercom device, commercially available from Bally Manufacturing. For a discussion of player card tracking devices, see, for example, U.S. Pat. No. 5,429,361 to Raven et al., incorporated by reference herein.

Processor 102 is further operatively connected to random number generator 130 and reel controller 132. Random number generator 130 may be an electronic pseudo-random number generator, commonly known to one of ordinary skill in the art, which determines a random number from a random electrical event or combination of events. Reel controller 132 is an electro-mechanical device, likewise known to one of ordinary skill in the art, which controls, monitors and records the position of slot reels 134, 136 and 138. The random number generator is described herein as generating random numbers between 1 and 10648, but may be configured in other manners, as will be apparent to one of ordinary skill in the art.

As discussed above, a player may initiate a game on electronic gaming device 100 by actuating starting controller 128. Thereafter, processor 102 initiates the random number generator 130 to generate a random number and transmit such number back to processor 102. Processor 102 looks up the generated random number in the appropriate field of the probability table 114, discussed further with regard to FIG. 2B, and retrieves the corresponding reel combination, or individual game result. Processor 102 then directs a reel controller 132 to spin reels 134, 136 and 138 and to stop at a point when a combination of symbols corresponding to the retrieved individual game result is displayed. Reels 134, 136 and 138 are described herein as having twenty-two possible positions in which each may stop, however the reels may be configured to have either more or less than twenty-two possible final positions.

In alternative embodiments, the electronic gaming device does not include the reel controller 132, or reels 134, 136 and 138. Instead, a video display (not shown) graphically displays representations of objects contained in the selected game, such as graphical slot reels or graphical playing cards. These representations are preferably animated to simulate the play of the selected game.

Referring now to FIG. 2A, a payout table 116 is depicted. As described above, payout table 116 is stored in data storage device 110 of electronic gaming machine 100. Payout table 116 contains an outcome field 202 and default payout field 204, each of which are depicted with exemplary data content. Outcome field 202 contains a record for each possible combination of outcomes that can be displayed by slot reels 134, 136 and 138 for which a player will be paid after completion of a game. As described below, in conjunction with FIG. 4, payout table field 116 may comprise further modified payout fields (not shown) containing increased payouts for application when a player is playing the electronic gaming device 100 in a "bonus" mode.

Default payout field 204 contains data corresponding to a payout in units of credits that will be paid for each combination listed in outcome field 202. For example, the second record in payout database 116 lists the combination "cherry/any/any" in outcome field 202. This corresponds to first slot reel 134 displaying a "cherry" symbol and slot reels 136 and 138 displaying any other symbol. The corresponding payout as listed in the second record of default payout field 204 is two credits for each credit deposited by the player.

FIG. 2B depicts a probability table 114 stored in data storage device 110 of electronic gaming device 100. Probability table 114 is preferably a database containing outcome field 206, default random number field 208, default expected hits per cycle field 210, bonus random number field 212 and bonus expected hits per cycle field 214. Each record in outcome field 206 corresponds to a possible combination displayed by slot reels 134, 136 and 138 after completion of a game. Each possible combination has corresponding data in fields 208, 210, 212 and 214. Default fields 208 and 210 represent the random numbers and expected hits per cycle when the electronic gaming device 100 is played at a default participation rate (e.g. 600 games per hour) and frequency of outcomes. These default rates may be predetermined by the operator of electronic gaming device 100. Bonus fields 212 and 214 represent the random numbers and expected hits per cycle, respectively, for instances when the electronic gaming device 100 is being played at a higher participation rate and/or with a greater frequency of outcomes (e.g. in a "bonus" mode). When a player achieves a predetermined participation rate and/or frequency of outcomes, he or she may qualify for increased payouts, as discussed further below and with regard to FIGS. 5A and 5B.

For example, the last record in probability field 114 lists the combination "7/7/7" in outcome field 202. This corresponds to slot reels 134, 136 and 138 each displaying the symbol "7". In default mode, electronic gaming device will display the combination "7/7/7" when random number generator 130 generates the random number 10648. For a three-slot reel electronic gaming device as depicted in FIG. 1, where each of slot reels 134, 136 and 138 has twenty-two positions at which they may stop, a cycle is determined as by (Number of positions per slor reel)^(Number of slot reels). In this case $22^3$=10,648. Thus, the result of "7/7/7" is expected to happen one time out of every 10,648 games played on the electronic gaming device, as listed in the corresponding record of field 210. When device 100 is in "bonus" mode, the result of "7/7/7" will result when random number generator 130 generates the random number 10647 or 10648. This is expected to happen twice in every cycle, while the machine is in "bonus" mode. Thus, the chances of the player hitting the top jackpot are doubled in "bonus" mode.

FIG. 3 illustrates a frequency-of-outcomes database 119 stored in data storage device 110 of electronic gaming device 100. Frequency-of-outcomes database 119 is preferably a database that includes participation rate field 302 and frequency of outcomes adjustment field 304. Participation rate field 302 contains a series of condition that, if met, will increase the frequency with which electronic gaming device 100 will complete a game. Recalling that an electronic gaming device 100 is configured to automatically commence a game, a player's participation rate is determined by dividing the number of games in which a player participates by the number of games commenced. Electronic gaming device 100 may be configured to identify a player via a player identification card (not shown) inserted by the player into card reader/writer 128. Electronic gaming device 100 may further be configured to identify a player who does not present a player identification card. This may be accomplished by, for example, monitoring the participation rate in a series of games and assuming the same player is playing unless (i) a predetermined amount of time lapses and a participation is not indicated or (ii) if a predetermined number of games are commenced without a participation from the player. The current player's participation rate may be stored in RAM 104 or data storage device 110. In addition, historical participation rates for a plurality of previous games may be compiled and stored in a like manner.

Frequency of outcomes adjustment field 304 contains, for each record stored in field 302, the amount by which electronic gaming device will adjust the frequency with which a game is completed. The electronic gaming device 100 determines the actual participation rate of the current player and determines which of the ranges stored in participation rate field 302 the player's rate falls into. Electronic gaming device 100 then adjusts the frequency of outcomes in accordance with the value stored in the corresponding record of field 304.

For example, electronic gaming device 100 will measure a player's participation rate, as discussed below with reference to FIGS. 5A and 5B. The participation rate is the number of games played by the player divided by the number of games started by gaming device 100. In an exemplary embodiment, processor 102 is programmed according to program 112 to measure a player's participation rate. When the player's participation rate is greater than or equal to ninety-five percent, processor 102 will look up the participation rate in participation rate field 302 and determine from frequency of outcomes adjustment field 304 that the speed within which games are to be completed is to be increased by ten percent. This may be accomplished by, for example, increasing the speed at which reels 134, 136 and 138 will spin and/or by decreasing the time between each spin of the reels 134, 136 and 138.

Referring now to FIG. 4, bonus database 118 preferably contains frequency of outcomes field 402 and payout multiplier field 404. Frequency of outcomes field 402 contains a series of conditions that, when met, will result in the payouts listed in payout field 204 to be multiplied by the corresponding value in payout multiplier field 404. For example, processor 102 will be programmed according to program 112 to monitor the rate at which games are being played. Referring to the second record of bonus database 118, in an exemplary embodiment, when processor 102 determines that a player is playing at a rate between seven hundred and eight hundred games per hour, it may activate a payout multiplier of 1.02. Thus if a player plays a game with an outcome that normally pays 50 credits, the machine in "bonus" mode will apply the bonus multiplier and pay 51 credits. For payouts in which a fractional credit amount results, the machine may track and maintain such fractional amounts, or round the fractional amount to the nearest whole credit value.

In an alternate embodiment, it is contemplated that instead of a bonus multiplier being provided, a modified payout field with increased payouts could be added as an additional field (not shown) to payout table 116. When the machine is in "bonus" mode, the increased payouts would be applied, rather than the payouts listed in default field 204 as multiplied by a value from payout multiplier field 404.

Referring now to FIG. 5A, a process 500 for initiating and completing a game according to the present invention is illustrated. At step 502, electronic gaming device 100 is programmed through program 112 to provide an interval for a player to make a payment. This is accomplished where processor 102 receives program instructions from program 112 stored in data storage device 110 to monitor clock signals from clock 108. After a predetermined number of clock signals have been received, processor 102 will determine that the interval for payment has ended. The interval may end before, during or after step 508, as discussed further below.

At step 504, processor 102 determines if a monetary input has been received. During the interval, a player may provide a payment by depositing currency into currency acceptor 144. However, if the player has a credit balance stored in RAM 106 and/or data storage device 110, he may actuate starting controller 128 to indicate that payment from the credit balance is to be applied to the current game. Processor 102 will monitor currency acceptor 144 and starting controller 128 during the interval for such inputs. If a monetary input is received the process continues to step 506. If monetary payment is not received the process continues at step 508, below. At step 506, processor 102 is programmed to store the monetary input by updating the credit balance stored in RAM 106 or data storage device 110.

At step 508, processor 102 is programmed to initiate a new game. As discussed above, the interval may end before, during or after step 508. In an embodiment where electronic gaming device 100 is a slot machine, the game is initiated by spinning slot reels 134, 136 and 138. In an embodiment where electronic gaming device 100 is a video poker machine, the game is initiated by generating an appropriate number of video representations of video poker cards.

Initiation of the game may be accomplished after a predetermined amount of time has passed since the completion of a previous game. In this instance, processor 102 would monitor clock signals generated by clock 108. After a predetermined number of clock signals have been detected by processor 102, the game will be initiated by processor 102 sending a signal to reel controller 132 to spin reels 134, 136 and 138. In an alternate embodiment, initiation of the game may, however, be prompted earlier than the predetermined time measured by processor 102 by a player depressing the starting controller 128 before the expiration of the predetermined time.

At step 510, processor 102 is programmed to determine whether a participation signal has been received from the player for the current game. This may be accomplished where processor 102 monitors for an input received from starting controller 128. At this step, the interval for payment will terminate if it was provided after the initiating step. If a participation signal has been received, the process continues to step 511. Otherwise the process continues to step 514, below.

At step 511, when a participation signal has been received, processor 102 is programmed to update the measured participation rate for the current player. At step 512, the amount a player has indicated to be wagered is deducted by processor 102 from the credit balance stored in RAM 106 and/or data storage device 110. Furthermore, the resulting credit balance will be stored in its place.

At step 514, processor 102 signals random number generator 130 to generate a random number to be used for determining the outcome of the game. At step 516, the random number is compared by processor 102 to the probability table 114 stored in data storage device 110. If the device 100 is in default mode, processor 102 retrieves the outcome from outcome field 206 corresponding to the random number listed in random number field 208, and at step 518 directs reel controller 132 to command reels 134, 136 and 138 to display the correct outcome. If the device 100 is in "bonus" mode, the outcome from outcome field 206 which corresponds to the random number stored in random number field 212 is selected and the process continues to step 518 in the same manner.

Referring now to FIG. 5B, process 500 continues at step 520 where processor 102 is programmed to determine if the outcome has an associated payout. Processor 102 compares the outcome to outcome field 202, and if a match is found, the corresponding payout is retrieved from default payout field 204.

For example, if device 100 is in default mode and random number 10420 is generated in step 514, processor 102 will direct reel controller 132 to have reels 134, 136 and 138 to display the outcome "bar/orange/bar", which corresponds to the outcome listed in outcome field 206. Processor 102 will then look up the outcome in outcome field 202 and retrieve the default payout of ten credits.

At step 522, processor 102 is programmed to determine if a bonus multiplier is to be applied. This is accomplished by having processor 102 monitor the frequency of outcomes for device 100. The frequency of outcomes, as discussed above, is a measurement of how quickly gaming device 100 is completing games. The frequency of outcomes may be determined according to how many games are completed within a predetermined time period. For example, if device 100 is completing an average of twelve games a minute for a predetermined time or after a predetermined number of games, processor 102 may be programmed to extrapolate that the machine's average rate is seven hundred-twenty games per hour.

At step 524, processor 102 determines the resultant payout by multiplying any payout due to a player by the bonus multiplier. Continuing with the previous examples where a player receives the outcome of "bar/orange/orange" and is playing at an average rate of 720 games per hour, processor 102 then looks up this average in field 402 of bonus database 118 and retrieves the corresponding bonus payout multiplier of 1.02. The payout of ten credits is then multiplied by the bonus multiplier of 1.02, resulting in a payout due of 10.2 credits.

At step 526, processor 102 will dispense the resulting payout to the player. This may be accomplished by directing hopper controller 146 to dispense a corresponding amount of currency into hopper 148. Alternatively, processor 102 may update the credit balance stored in RAM 106 and/or data storage device 110.

While the best mode contemplated for carrying out the invention has been described in detail in the foregoing, those of ordinary skill in the art to which the instant invention relates will recognize various alternative designs and embodiments for practicing the invention. Accordingly, it is to be understood that the foregoing description is provided for illustrative purposes only and does not limit the scope of the instant invention, as defined by the appended claims.

We claim:

1. A method for directing the operation of an electronic gaming device, comprising:

generating a random number for a game;

determining an outcome of the game based on the random number;

spinning a slot reel having a position corresponding to the outcome;

providing to a player, after the spinning step, an interval to make a payment for the game;

revealing the position to the player after the interval, thereby displaying the outcome of the game;

wherein the operation of the electronic gaming device is automatically initiated;

providing a plurality of games to the player, each of the plurality of games having a payout table associated therewith;

determining a participation rate from the plurality of games;

storing a predetermined rate;

comparing the participation rate to the predetermined rate; and adjusting a game parameter for a subsequent game, based on the comparing step.

2. The method of claim 1, wherein the adjusting step further comprises:

increasing at least one element of the payout table of the subsequent game.

3. The method of claim 1, wherein the adjusting step further comprises:

providing a bonus to the player.

4. The method of claim 1, wherein the adjusting step further comprises:

increasing a rate of play of the device.

5. A method for operating an electronic gaming device, comprising:

generating a random number for a game;

determining an outcome of the game based on the random number;

spinning a slot reel having a position corresponding to the outcome;

providing to a player, after the spinning step, an interval to make a payment for the game;

revealing the position to the player after the interval, thereby displaying the outcome of the game;

wherein the operation of the electronic gaming device is automatically initiated;

receiving a signal, from the player, to increase a frequency of outcomes of the device; and increasing the frequency of outcomes of the device in response to the signal, wherein the increasing step includes adjusting a payout table associated with the device.

6. A method for directing operation of an electronic gaming device, comprising:

spinning a slot reel;

receiving an input from a player, after the spinning step;

generating a random number in response to the input;

determining an outcome based on the random number, the outcome corresponding to a position of the slot reel;

stopping the slot reel at the position corresponding to the determined outcome after the receiving step;

wherein the operation of the electronic gaming device is automatically initiated;

storing a predetermined time;

measuring a current time;

comparing the predetermined time and the current time; and generating the random number for the game, based on the comparing step.

7. The method of claim 6, wherein the current time is measured from a completion of a previous game.

8. The method of claim 6, wherein the predetermined time is measured from a completion of a previous game.

9. A method for directing operation of an electronic gaming device, comprising:

spinning a slot reel;

receiving an input from a player, after the spinning step;

generating a random number in response to the input;

determining an outcome based on the random number, the outcome corresponding to a position of the slot reel;

stopping the slot reel at the position corresponding to the determined outcome after the receiving step;

wherein the operation of the electronic gaming device is automatically initiated;

storing a predetermined time;

measuring a current time;

comparing the predetermined time and the current time; and providing an interval to make the payment, based on the comparing step.

10. The method of claim 9, wherein the current time is measured from a completion of a previous game.

11. The method of claim 9, wherein the predetermined time is measured from a completion of a previous game.

12. A method for directing operation of an electronic gaming device, comprising:

spinning a slot reel;

receiving an input from a player, after the spinning step;

generating a random number in response to the input;

determining an outcome based on the random number, the outcome corresponding to a position of the slot reel; and stopping the slot reel at the position corresponding to the determined outcome after the receiving step;

wherein the operation of the electronic gaming device is automatically initiated; and wherein the spinning step further comprises:

storing a predetermined time;

measuring a current time;

comparing the predetermined time and the current time; and spinning the slot reel, based on the comparing step.

13. The method of claim 12, wherein the current time is measured from a completion of a previous game.

14. The method of claim 12, wherein the predetermined time is measured from a completion of a previous game.

15. A method for providing an electronic game, comprising:

initiating a plurality of games, each of the plurality of games having a payout table associated therewith;

determining an outcome of each of the plurality of games;

measuring at least one of a participation rate and a frequency of outcomes for the plurality of games;

adjusting a game parameter for a subsequent game based on the measuring step; and adjusting at least one element of the payout table of the subsequent game, wherein the above mentioned steps are automatically initiated.

16. The method of claim 15, wherein the adjusting step further comprises:

providing a bonus to the player.

17. The method of claim 15, wherein the adjusting step further comprises:

increasing a frequency of outcomes of the device.

18. An apparatus for providing an electronic game, comprising:

means for initiating a plurality of games, each of the plurality of games having a payout table associated therewith;

means for determining an outcome of each of the plurality of games;

means for measuring at least one of a participation rate and a frequency of outcomes for the plurality of games; and means for adjusting a game parameter for a subsequent game based on the measuring step.

19. An apparatus for providing an electronic game, comprising:

a storage device; and a processor connected to the storage device, the storage device storing a program for controlling the processor; and the processor operative with the program to:

initiate a plurality of games, each of the plurality of games having a payout table associated therewith;

determine an outcome of each of the plurality of games;

measure at least one of a participation rate and a frequency of outcomes for the plurality of games; and adjust a game parameter for a subsequent game based on the measuring step.

20. A computer readable medium encoded with processing instructions for implementing a method for providing an electronic game, the method comprising:

initiating a plurality of games, each of the plurality of games having a payout table associated therewith;

determining an outcome of each of the plurality of games;

measuring at least one of a participation rate and a frequency of outcomes for the plurality of games; and adjusting a game parameter for a subsequent game based on the measuring step.

* * * * *